United States Patent [19]

Carroll et al.

[11] 4,102,453

[45] Jul. 25, 1978

[54] NESTING AND STACKING CONTAINER

[75] Inventors: James C. Carroll; Lewis T. Johnson, both of Bartlesville, Okla.

[73] Assignee: Phillips Petroleum Company, Bartlesville, Okla.

[21] Appl. No.: 700,705

[22] Filed: Jun. 28, 1976

[51] Int. Cl.[2] ..... B65D 21/04

[52] U.S. Cl. ..... 206/507

[58] Field of Search ..... 206/505, 506, 507

[56] References Cited

U.S. PATENT DOCUMENTS

| | | | |
|---|---|---|---|
| 2,252,964 | 8/1941 | Faulker | 206/506 |
| 2,931,535 | 4/1960 | Lockwook | 206/507 |
| 3,113,680 | 12/1963 | Frater | 211/126 |
| 3,404,804 | 10/1968 | Frater | 206/505 |
| 3,481,507 | 12/1969 | Sanders | 206/507 |

*Primary Examiner*—George E. Lowrance

[57] ABSTRACT

A nesting and stacking container adapted to nest within a like oriented lower container of like construction, and also adapted to stack on a said lower container in a "high-stack" position without rotating the upper container with respect to the lower container. In a preferred embodiment a said upper container can also be stacked within a said lower container at an "intermediate-stack" position without rotating the upper container with respect to the lower container. Thus, in the preferred embodiments, a three-position container is provided.

17 Claims, 32 Drawing Figures

NESTING AND STACKING CONTAINER

This application relates to a nesting and stacking container.

Nesting and stacking containers, e.g., containers so constructed that an upper container will nest within or stack on a lower container of like construction when said upper container is rotated to a different orientation are well known in the art. Such containers have great utility in various industries, e.g., the baking industry. However, one frequently troublesome and undesirable problem with such containers is the different orientation required when one container is stacked on, or nested within, a like lower container. In manual handling the operator will frequently misorient the container being nested or stacked, resulting in increased handling of the container and loss of time. Moreover, automation of the handling of such containers is difficult. In recent times it has become increasingly desirable to have a container which will nest within, or stack on, a like container of like orientation, i.e., without rotating the upper container with respect to the lower container. Only a few such containers are known to the art and/or are commercially available. It is even more desirable to have a container which will nest within a like oriented container of like construction, and which can also be stacked with a like container at two or more elevations without the necessity of rotating the upper container with respect to the lower container. Even fewer of such containers are known to the art and/or are commercially available. Insofar as is presently known those which are commercially available tend to be of complicated and/or impractical design.

It is also desirable that containers of the type considered herein be of light weight and sturdy construction, and can be economically fabricated from moldable materials such as plastics and metals. For example, it is desirable that such containers be provided with maximum vertical strength in the wall portions (commensurate with the weight of the container) so that when a number of filled containers are stacked vertically the lowermost containers in the stack will not be collapsed or become warped.

It is also desirable that said containers be provided with convenient handle means for manual handling. Even though mechanical handling of such containers, and particularly the palletizing of groups of such containers, is being more and more widely employed, there are still steps in said mechanical handling operations where the containers must be handled manually. It is further desirable that the containers be provided with substantially flat walls, if possible, to facilitate mechanical handling such as on conveyor belts, etc.

Attaining all of the above advantages or features in one container has been extremely difficult. The side and end walls of containers have been provided with corrugations or convolutions so as to provide increased vertical strength thereto. However, this has created problems in the handling of said containers due to interlocking of said corrugations or convolutions when the ends of containers encounter one another in use, as on conveyor belts or when placed side by side. Containers in the past have been commonly provided with handles by providing an opening in opposed walls adjacent the top thereof. Such handle openings weaken said walls. Furthermore, such openings provide places where the contents of the container can be damaged by the fingers of the person handling the container.

The present invention solves the above problems by providing a nesting and stacking container which is not subject to the above difficulties or limitations. The improved containers of the invention are provided with an improved wall structure which makes it possible to nest an upper container within a like oriented lower container of like construction, and also to stack a said upper container on a said lower container in a "high-stack" position without rotating said upper container with respect to the lower container. In a preferred embodiment said upper container can also be stacked within a like lower container at an "intermediate-stack" position without rotating the upper container with respect to the lower container. Thus, the containers of the invention can be employed in handling a greater variety of products in a more economical and efficient manner. For example, in the handling of bakery products, the containers of the invention can be employed in a "high-stack" position when filled with relatively high products, e.g., cakes or loaves of bread, or can be employed in a "intermediate-stack" position when filled with products having a low height, e.g., rolls, pies, etc. Thus, a bakery operator can employ containers of the invention in multiple uses and eliminate the need for stocking several different types of containers for different types of products. Other advantages of the containers of the invention will be discussed below in connection with the more detailed description of the containers.

Thus, according to the invention, there is provided a generally rectangular nesting and stacking container comprising a generally horizontally disposed bottom, and opposed first and second wall structures respectively projecting upwardly from opposed first and second sides of said bottom, with each of said wall structures comprising, in combination: a plurality of spaced apart stacking feet disposed on a said side of said bottom; an upper rail member spaced from and disposed generally vertically above said side of said bottom; a plurality of spaced apart stacking saddles disposed on the inner surface of said upper rail member and in vertical alignment with said stacking feet; and a plurality of spaced apart and like inclined bar members extending upwardly in one direction only between said side of said bottom and the inner surface of said rail member and in the same vertical plane as said stacking feet and said stacking saddles; with said stacking feet, said stacking saddles, and said inclined bar members in each said wall structure being so arranged with respect to each other that an upper container will (a) stack vertically on a like oriented lower container of like construction when at least some of the stacking feet of said upper container are in vertical alignment with and in register with at least some of the stacking saddles in the corresponding wall structure of said lower container, and (b) nest vertically within said lower container when said upper container is moved diagonally downward into said lower container to place said bar members of said upper container parallel to said bar members in the corresponding wall structure of said lower container, with said stacking feet of the upper container out of register with the stacking saddles of said lower container.

Figure 3:
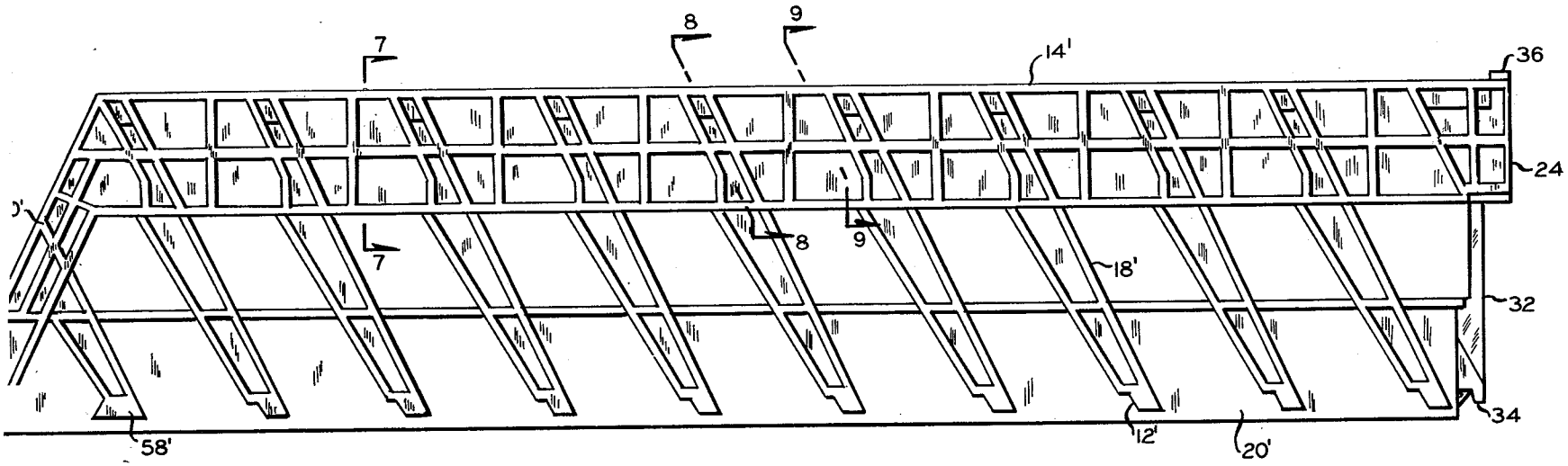
FIG. 3 is a side view in elevation of the container of FIG. 1.
Figure 7:
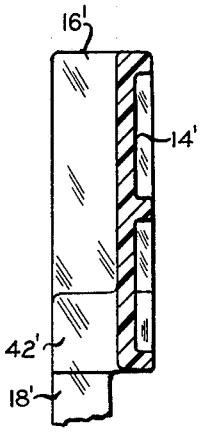
Figure 8:
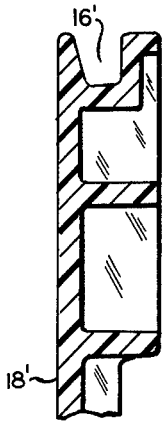
Figure 9:
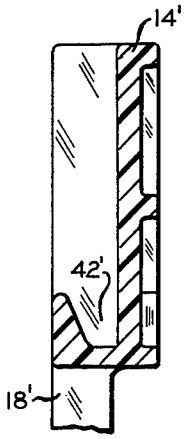

FIGS. 7, 8, and 9 are cross section views taken along the lines 7—7, 8—8, and 9—9, respectively, of FIG. 3.

Figure 4:
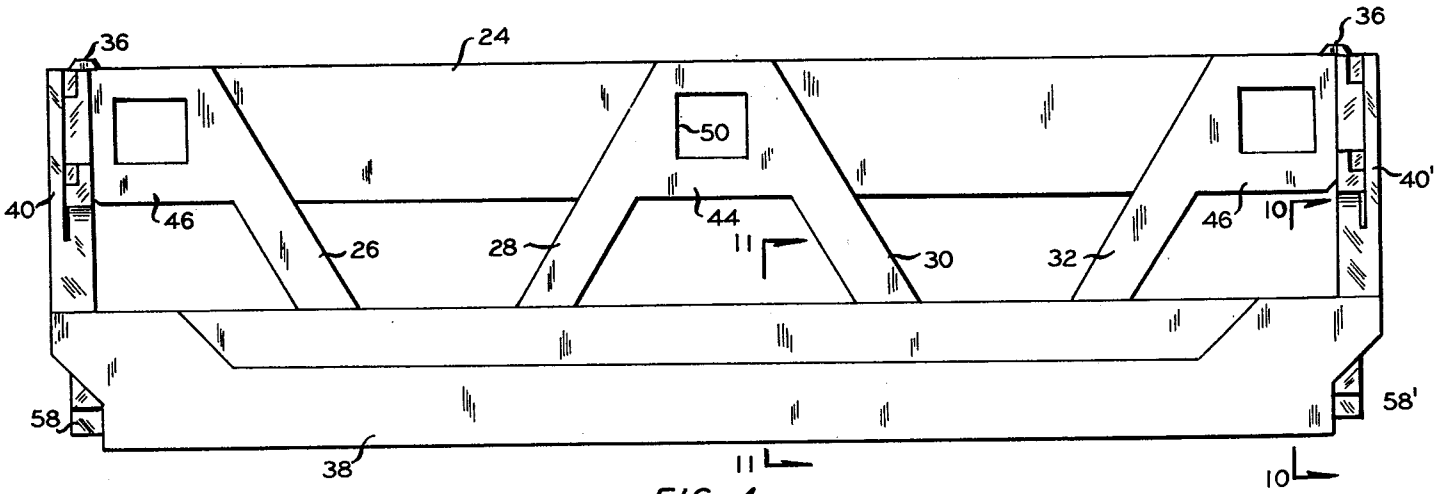
FIG. 4 is an end view in elevation of the open or front end of the container of FIG. 1.
Figure 10:
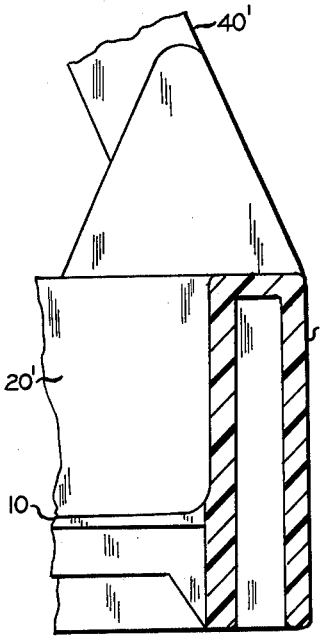
Figure 11:
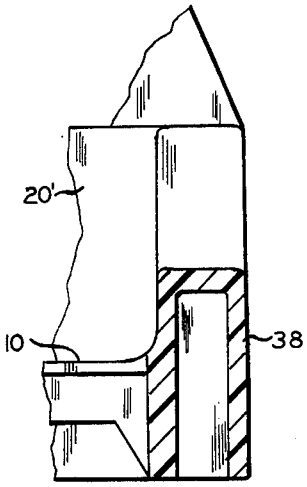

FIGS. 10 and 11 are cross section views taken along the lines 10—10 and 11—11, respectively, of FIG. 4.

Figure 5:
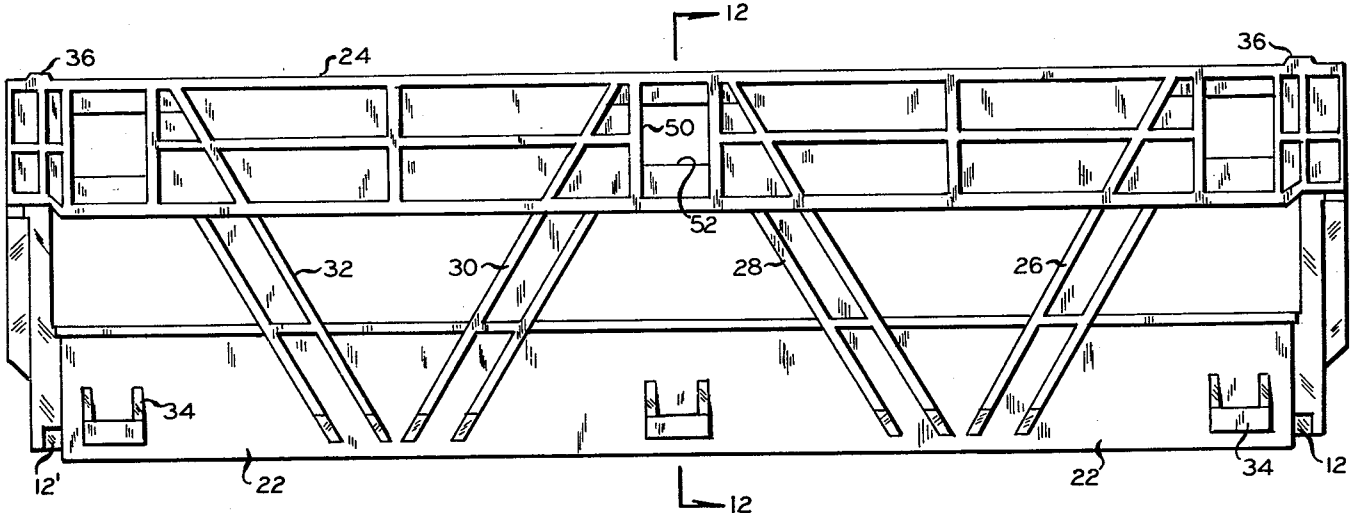
FIG. 5 is an end view in elevation of the closed or rear end of the container of FIG. 1.
Figure 6:
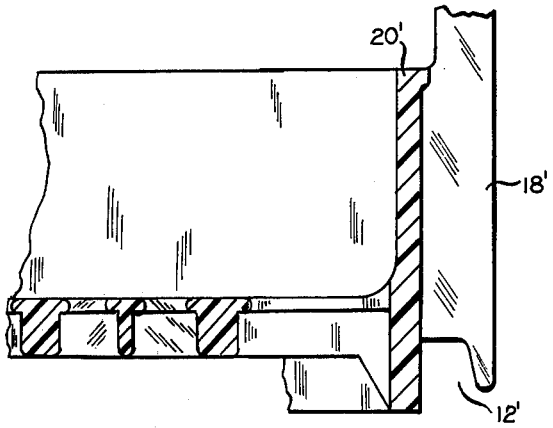
FIG. 6 is a cross section view taken along the lines 6—6 of FIG. 2.
Figure 12:
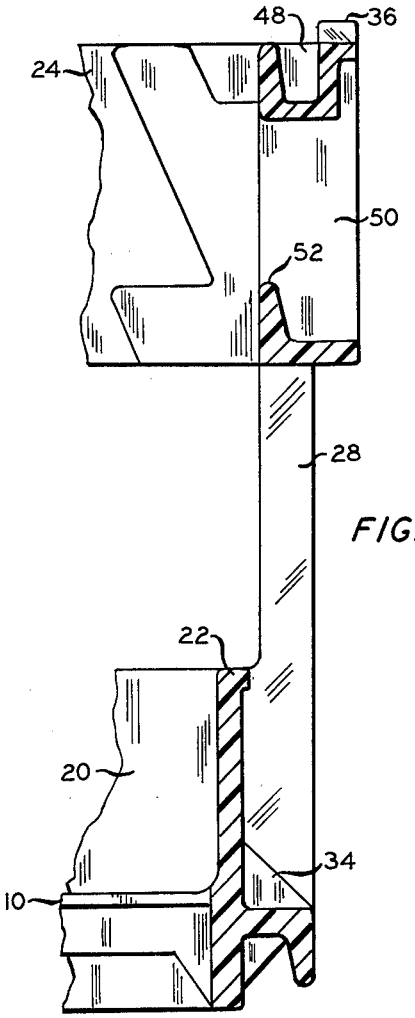

FIG. 12 is a cross section view taken along the line 12—12 of FIG. 5.

Figure 1:
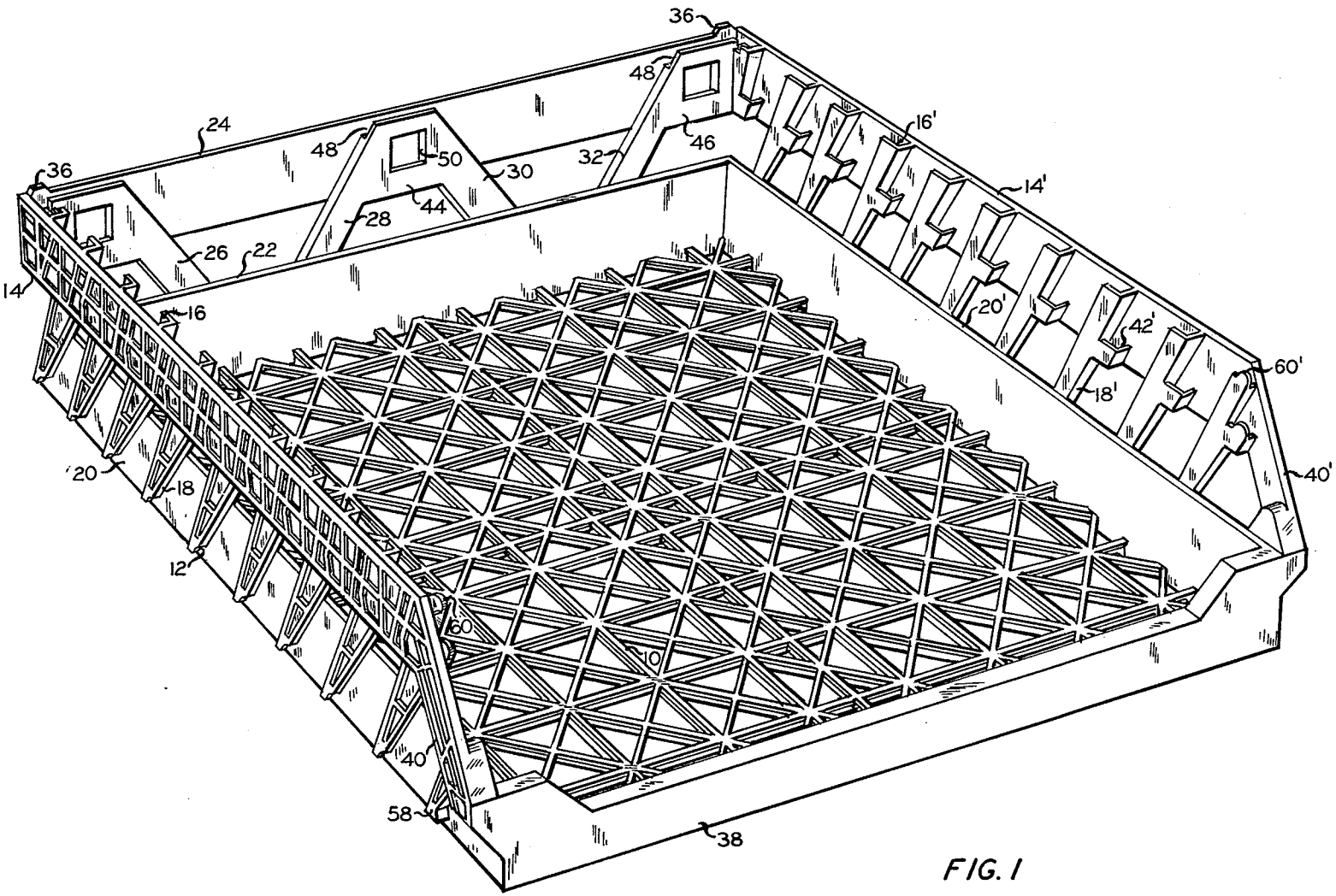
FIG. 1 is a top perspective view of one presently preferred container in accordance with the invention.
Figure 2:
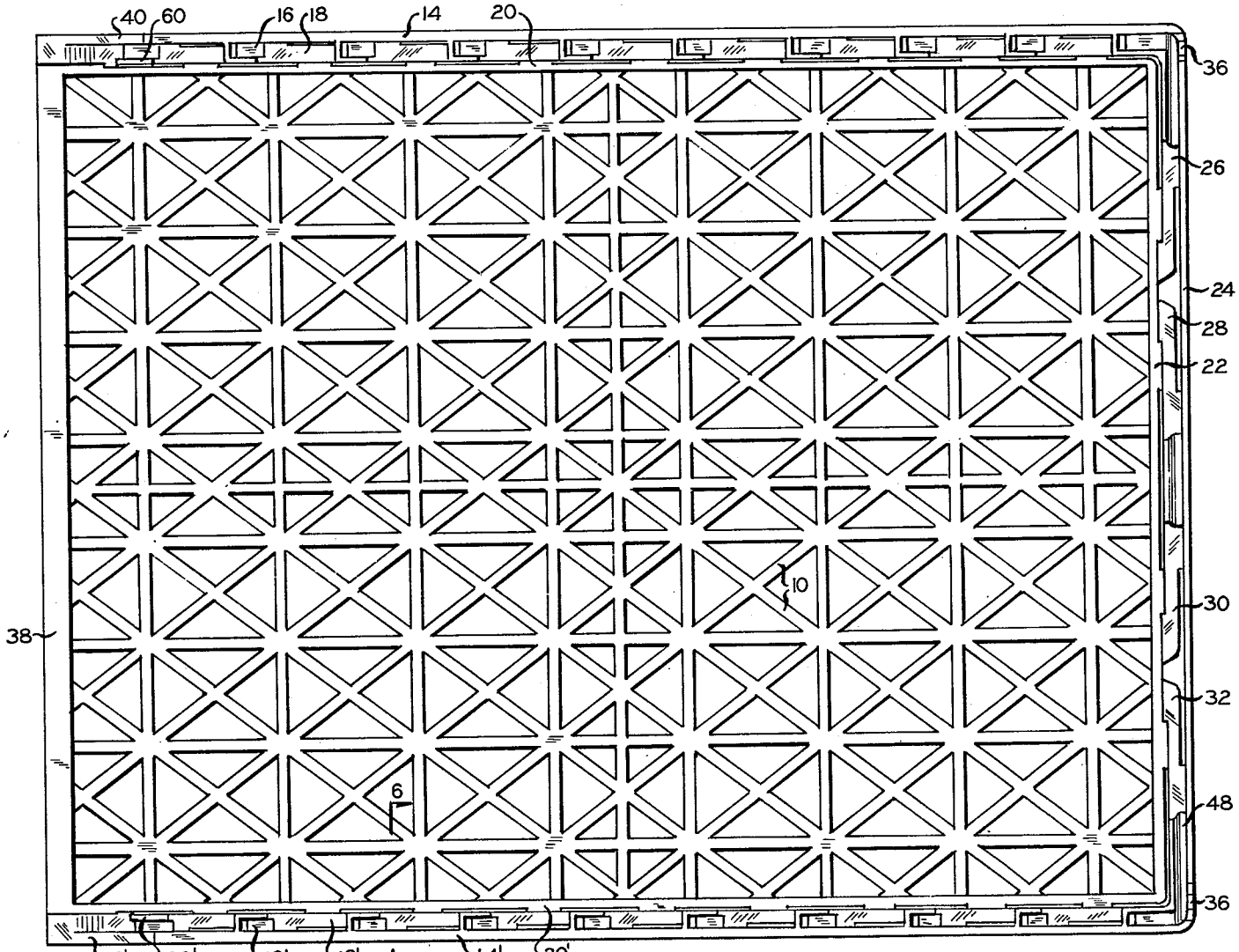
FIG. 2 is a top plan view of the container of FIG. 1.
Figure 13:
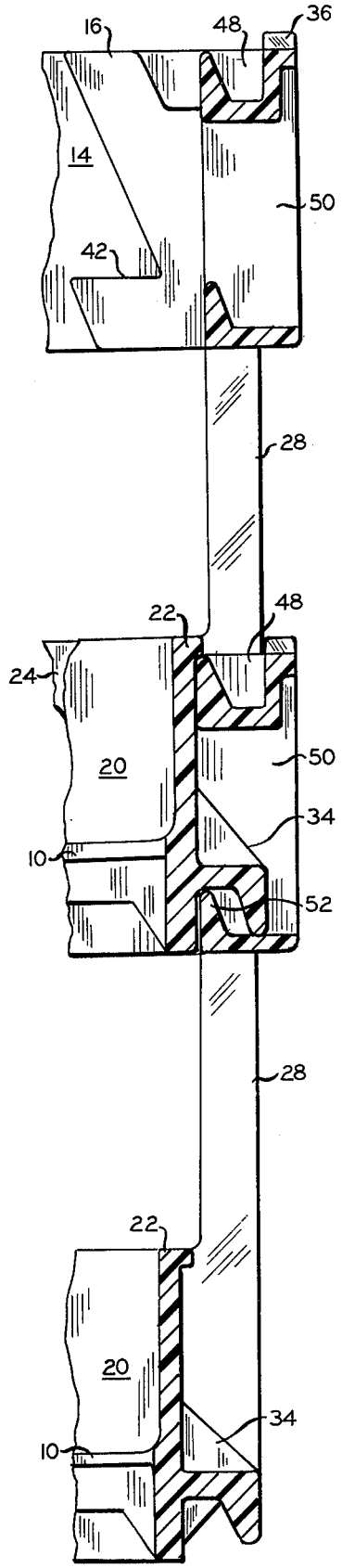

FIG. 13 is a cross section of two of the containers of FIG. 1 in an intermediate-stack relationship, and taken at a location corresponding to line 12—12 of FIG. 5.

Figure 13A:
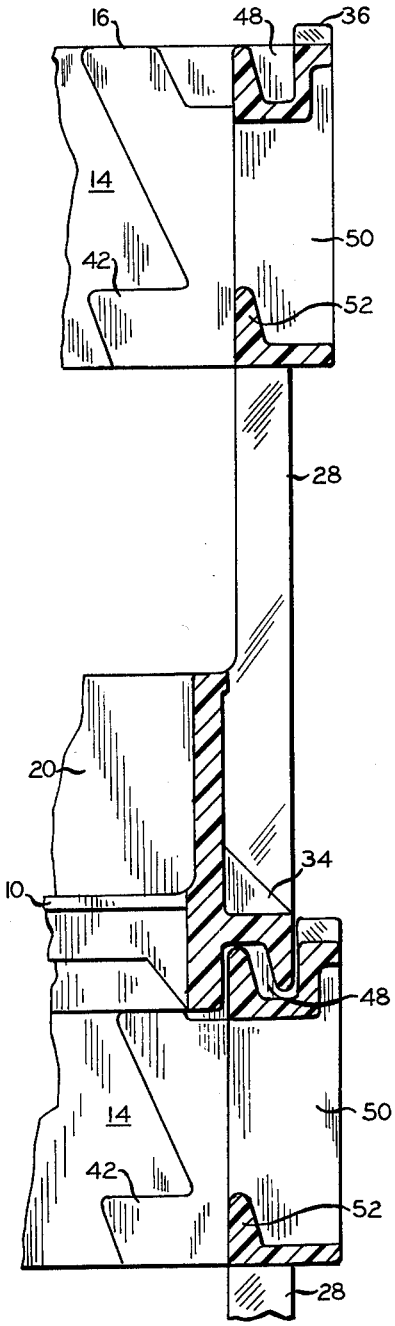

FIG. 13*a* is a cross section of two of the containers of FIG. 1 in a high-stack relationship, and taken at a location corresponding to line 12—12 of FIG. 5.

Figure 14:
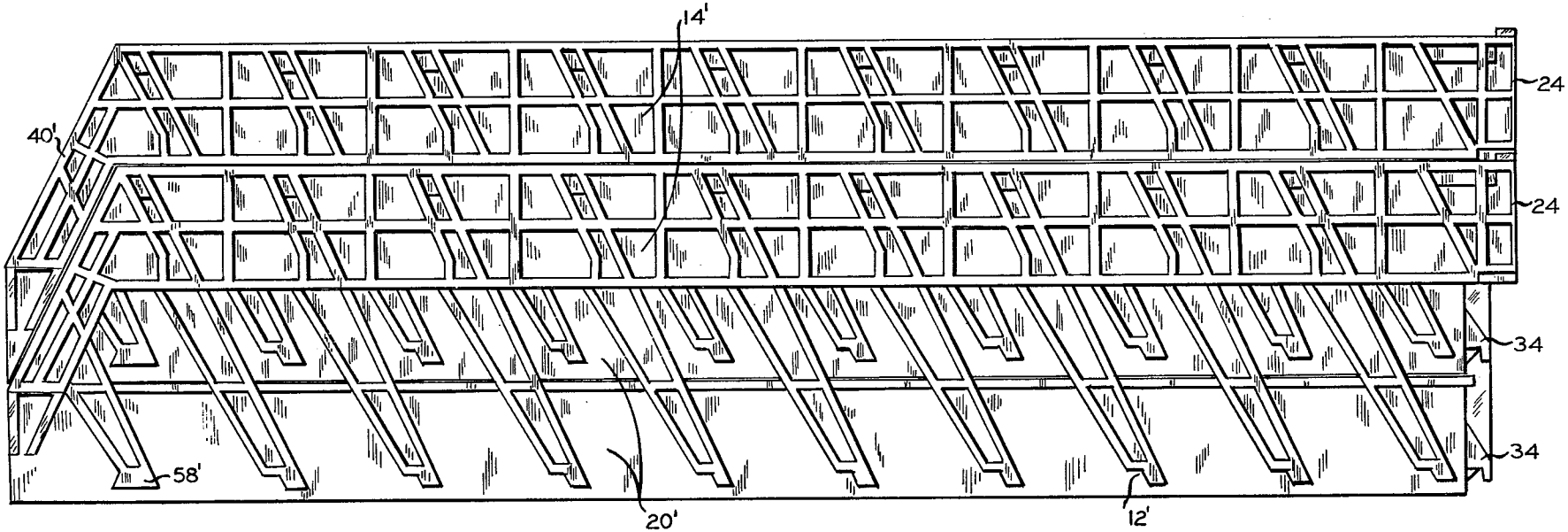

FIG. 14 is a side view in elevation showing two of the containers of FIG. 1 in a nested relationship.

Figure 15:
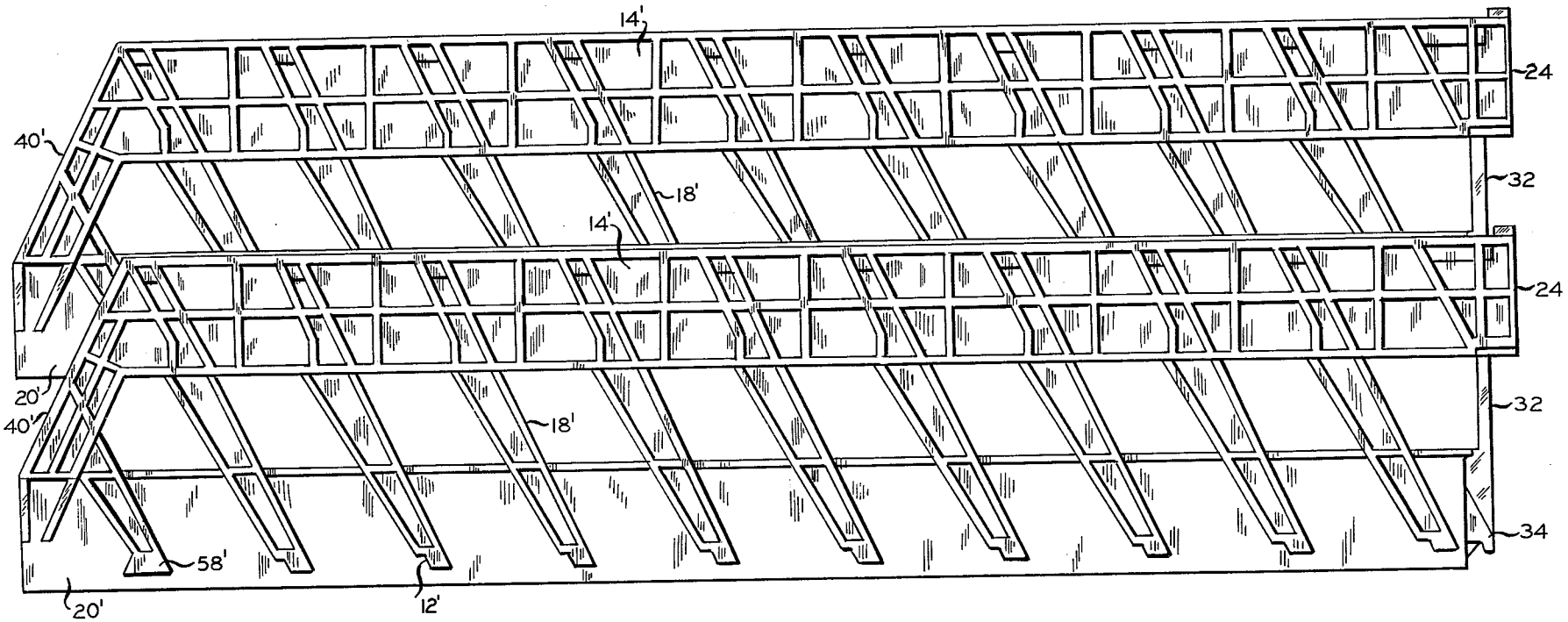

FIG. 15 is a side view in elevation showing two of the containers of FIG. 1 in an intermediate-stack relationship.

Figure 16:
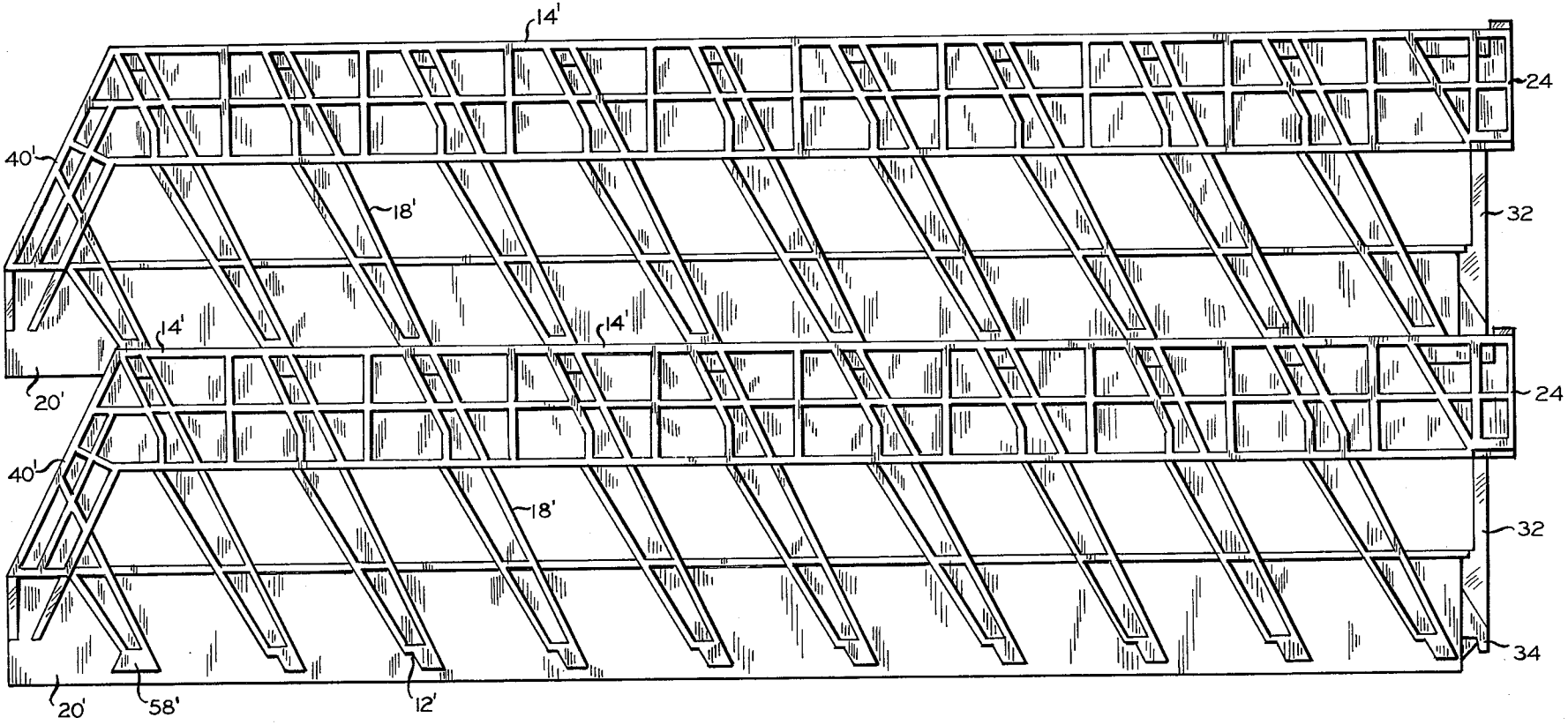

FIG. 16 is a side view in elevation showing two of the containers of FIG. 1 in a high-stack relationship.

Figure 17:
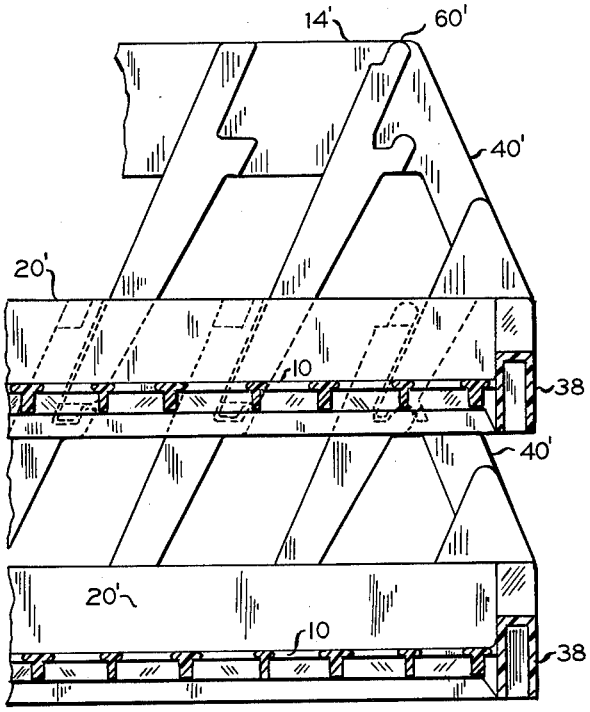

FIG. 17 is a partial side view in elevation (showing the other side of the wall structures shown in FIG. 15) and further illustrating two of the containers of FIG. 1 in an intermediate-stack relationship.

Figure 18:
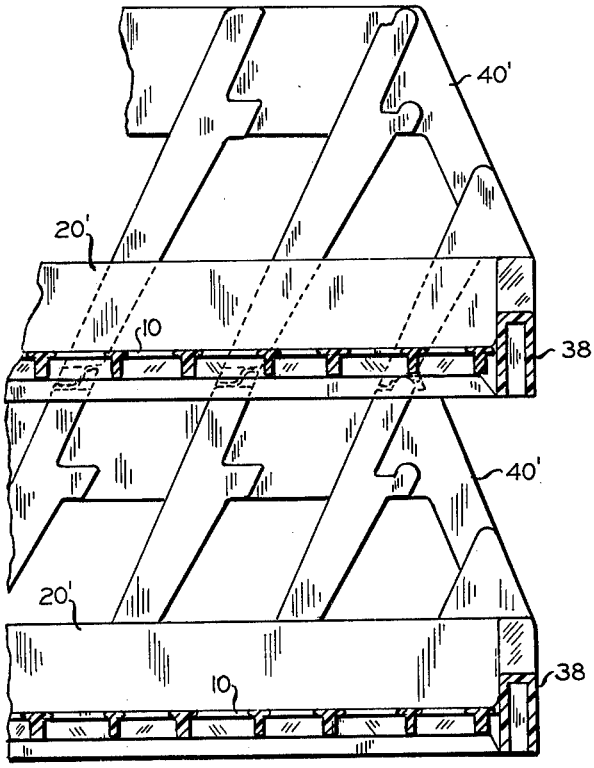
Figure 19:
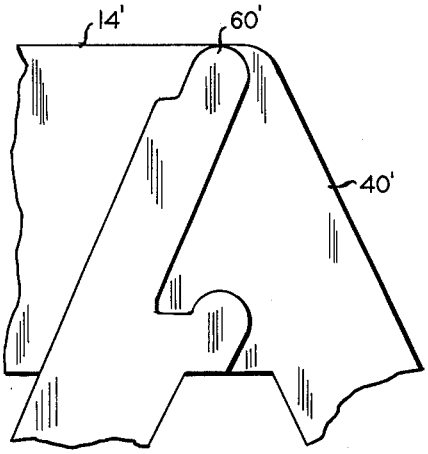
Figure 20:
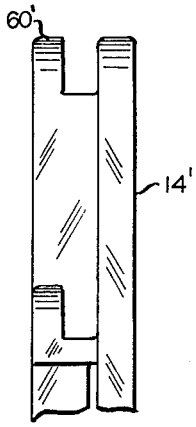
Figure 21:
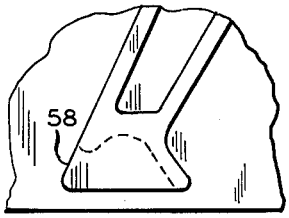
Figure 22:
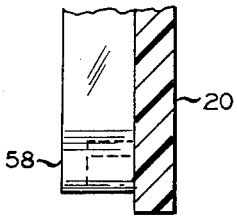

FIG. 18 is a partial side view in elevation (showing the other side of the wall structures in FIG. 16) and further illustrating two of the containers of FIG. 1 in a high-stack relationship.

FIGS. 19, 20, 21, and 22 are enlarged detailed views, in elevation and/or cross section, illustrating details of one of the blind stacking means provided on the container of FIG. 1.

Figure 23:
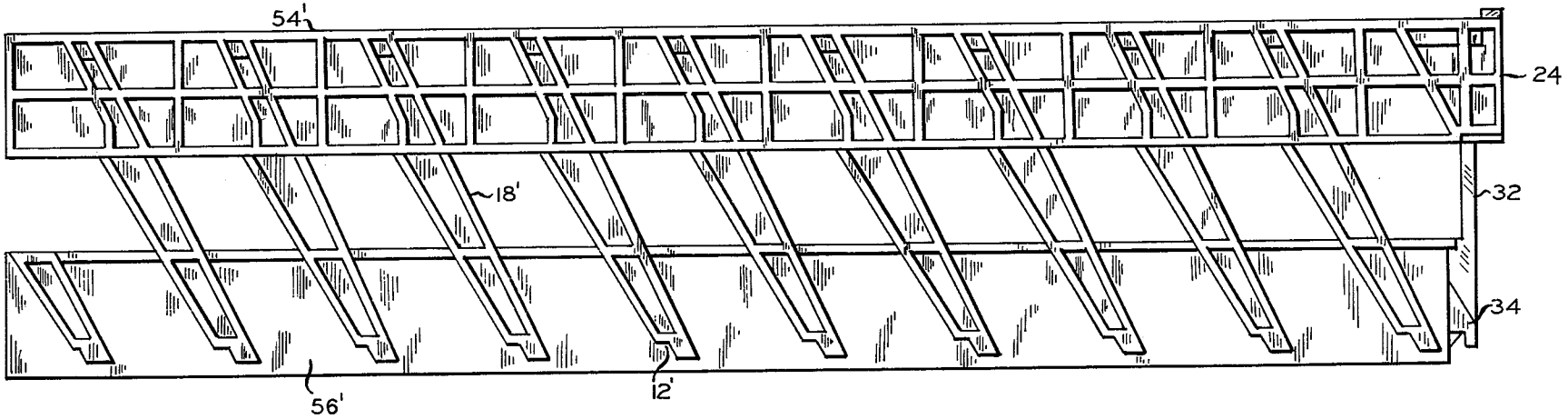

FIG. 23 is a side view in elevation illustrating a modification of the container of FIG. 1.

Figure 24:
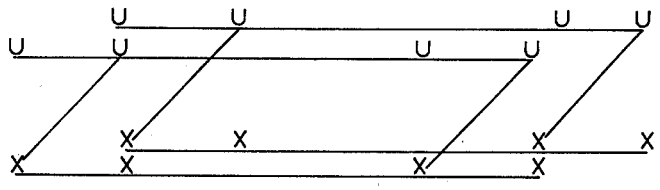

FIG. 24 is a diagrammatic side view illustrating two containers of the invention in another nesting relationship.

Figure 25:
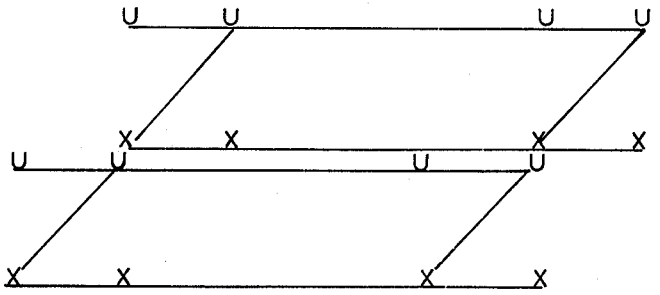
Figure 26:
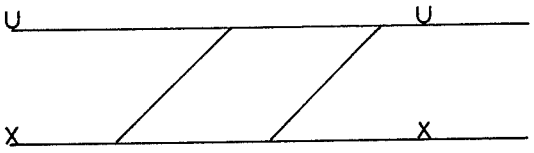
Figure 26A:
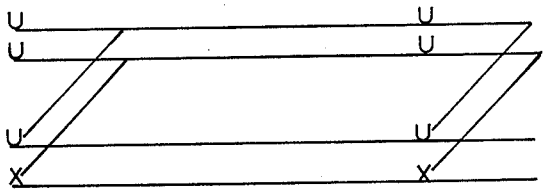
Figure 26B:
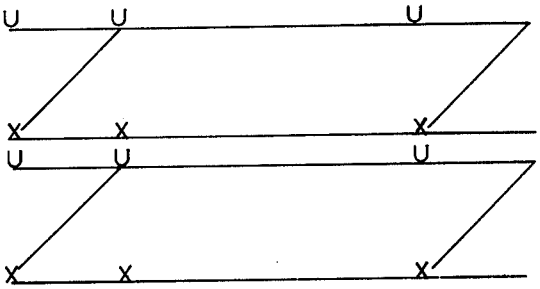

FIG. 25 is a diagrammatic side view illustrating two containers of the invention in another stacking relationship.

FIGS. 26, 26*a*, 26*b*, 26*c*, and 26*d* are diagrammatic side views illustrating alternate arrangements of the inclined bars, the stacking feet, and the stacking saddles in containers in accordance with the invention.

Figure 27:
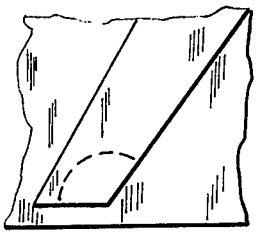
Figure 26C:
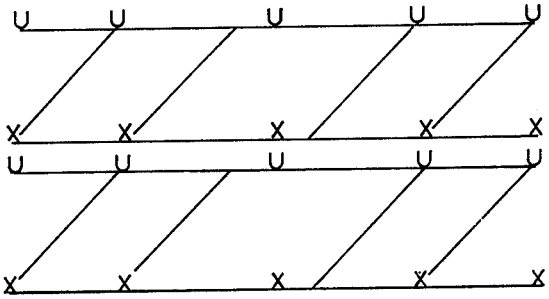
Figure 26D:
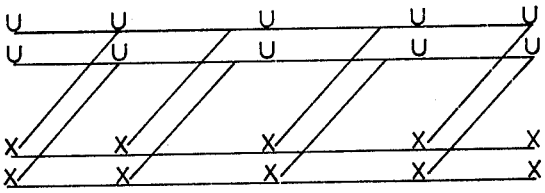

FIG. 27 is an enlarged detail view illustrating a modification of a forward stacking foot on the container of FIG. 1.

Referring now to the drawings, wherein like reference numerals are employed to denote like elements, the invention will be more fully explained. In FIGS. 1 to 22, the container there illustrated comprises, in one embodiment, a generally horizontally disposed bottom, and opposed first and second wall structures respectively projecting upwardly from opposed first and second sides of said bottom. Preferably, said bottom will comprise a suitable gridwork, here generally denoted by the reference numeral 10. However, said bottom can comprise any other suitable bottom means such as a planar sheet, a perforated planar sheet, etc.

Each of said first and second wall structures comprises a plurality of spaced apart stacking feet 12 or 12′ disposed on a said side of said bottom. An upper rail member 14 or 14′ is spaced from and disposed generally vertically above said side of said bottom. A plurality of spaced apart stacking saddles 16 or 16′ are disposed on the inner surface of said upper rail member and are in vertical alignment with said stacking feet. A plurality of spaced apart and like inclined bar members 18 or 18′ extend upwardly in one direction only between said side of said bottom and the inner surface of said rail members 14 and 14′, respectively. Said stacking feet, said stacking saddles, and said inclined bar members, in each said wall structure, are so arranged with respect to each other that a like oriented upper container will (a) vertically stack on a lower container of like construction when at least some of the stacking feet of said upper container are in vertical alignment with, and in register with, at least some of the stacking saddles in the corresponding wall structure of said lower container, and (b) vertically nest within said lower container when said upper container is moved diagonally downward into said lower container to place said bar members of said upper container parallel to said bar members in the corresponding wall structure of said lower container, with the stacking feet of the upper container out of register with the stacking saddles of said lower container.

Preferably, each of said first and second wall structures will also comprise a lower border flange 20 or 20′ which extends along a said side of said bottom in a first vertical plane which is located adjacent said side of said bottom. Preferably, said stacking feet 12 or 12′ are disposed on the outer surfaces of said border flanges 20 or 20′, respectively, in a second vertical plane which is located outside and adjacent said first vertical plane. Said upper rail members 14 or 14′ are each disposed in a third vertical plane which is located outside and adjacent said second vertical plane. Said stacking saddles 16 or 16′ are thus disposed on the inner surfaces of said upper rail members 14 or 14′, respectively, in said second vertical plane and in vertical alignment with said stacking feet. Said inclined bar members which extend between the outer surface of said border flange and the inner surface of said upper rail member are thus located in said second vertical plane. Preferably, the lower end of each of said bar members 18 or 18′ comprises a said stacking foot 12 or 12′, and the upper end of each of said bar members comprises a said stacking saddle 16 or 16′.

The number and spacing of said stacking feet, said stacking saddles, and said inclined bar members in said first and second wall structures is not critical. All that is required is that said feet and said saddles in a given container be vertically aligned; and that said bar members be like inclined in one direction only, i.e., all inclined in the same single direction and at substantially the same angle. When these requirements are met said feet, said saddles, and said bar members in each said wall structure can readily be so arranged that (a) a like oriented upper container will vertically stack on a lower container of like construction when at least some of the stacking feet of said upper container are in vertical alignment with, and in register with, at least some of the stacking saddles in the corresponding wall structure of said lower container, and (b) said upper container will vertically nest within said lower container when said upper container is moved diagonally downward into said lower container to place said bar members of said upper container parallel to said bar members in the corresponding wall structure of said lower container, with said stacking feet of the upper container out of register with the stacking saddles of said lower container. For example, see FIGS. 24, 25, and 26–26*d*.

Said FIGS. 24, 25, and 26–26*d* illustrate alternate arrangements of the stacking feet, the stacking saddles, and the inclined bar members in the first and second wall structures of containers in accordance with the invention. In said Figures the stacking feet are represented by *x*, and the stacking saddles are represented by *u*. It is preferred that said feet and said saddles be symmetrically spaced, and with some feet and some saddles at or adjacent the ends of the container, because this provides greater stability when a plurality of containers are stacked to considerable heights. However, it will be evident from this disclosure that considerable variation in the spacing of said feet and saddles is possible, and the containers will still stack and nest as described. From said Figures it is evident that it is not essential that the stacking feet and stacking saddles be located on the ends of the inclined bars.

In presently preferred embodiments, the containers of the invention will also be provided with a third or rear wall structure which is positioned between and generally perpendicular to said first and second wall structures. In said third wall structure a third lower border flange 22 extends along a third side of said bottom in a corresponding first vertical plane which is located adjacent said third side of said bottom. The ends of said third border flange 22 are connected to adjacent ends of said border flanges 20 and 20' in said first and second wall structures, respectively. A third upper rail member 24 is disposed generally vertically above said third border flange 22 in a corresponding third vertical plane which is located outside and adjacent a corresponding second vertical plane which is adjacent and outside said corresponding first vertical plane. A plurality of spaced apart inclined bar members, e.g., bar members 26, 28, 30, and 32, extend upwardly between the outer surface of said third border flange 22 and the inner surface of said third upper rail member 24 and are disposed in said corresponding second vertical plane. The number, the spacing, and the inclination of the bar members in said third wall structure are not critical. All that is required is that the location, arrangement, and inclination of said bar members be such that an upper said container will nest within a like oriented lower container of like construction with said bar members of the upper container paralleling said bar members of the lower container. When a third or rear wall structure is provided, the inclined bar members in the first and second wall structures must be inclined in a direction toward the front of the container, e.g., away from said third wall structure, when said third wall structure is provided with stacking lugs and stacking ledges, and/or intermediate stacking supports, as described hereinafter.

Referring now to FIG. 5, said third wall structure will also preferably comprise a plurality of spaced apart outwardly extending stacking lugs 34 which are disposed on the outer surface of said third border flange 22, in said corresponding second vertical plane, and at an elevation corresponding to the elevation of said stacking feet 12 and 12' in said first and second wall structures, respectively. Preferably, the bar members in said third wall structure will be successively inclined in opposite directions to form alternating truncated V-forms and inverted truncated V-forms. A plurality of spaced apart stacking ledges 48 are associated with the upper ends of said bar members on the inner surface of said third upper rail member 24, are disposed in said corresponding second vertical plane, in vertical alignment with said stacking lugs, and at an elevation corresponding to the elevation of said stacking saddles 16 and 16' in said first and second wall structures, respectively. See FIG. 1.

In preferred embodiments of the invention, the containers will be provided with a front blind stacking means. Thus, in each of said first and second wall structures, the upper end of the forward stacking saddle, e.g., the upper end of the inclined bar member which is most removed from said third wall structure, is curved (as at 60 and 60') and comprises one-half of a separable post and socket combination for guiding an upper container in one pre-stacking operation when said upper container is being stacked in a high-stack relationship on a like oriented lower container of like construction, as described further hereinafter. See FIGS. 1, 19, and 20. Similarly, in each of said first and second wall structures, the upper inner surface of the stacking foot 58 or 58' which is most removed from said third wall structure has a curvature corresponding to said curved upper end of said similarly located stacking saddle and comprises the other one-half of said post and socket combination.

In said preferred embodiments of the invention, the containers will also be provided with a rear blind stacking means. Thus, in each of said first and second wall structures, the border flanges 20 and 20', respectively, therein will preferably project vertically above and below the horizontal plane of the bottom panel of the container. A pair of boss members 36 project upwardly from said third upper rail member 24 at individual spaced apart positions which are located in said second vertical plane and are adapted to coact with and guide the downwardly extending portions of said border flanges 20 and 20' which are located in said first vertical plane, in another pre-stacking operation described further hereinafter.

Preferably, the above-described containers of the invention will also be provided with a fourth lower border flange 38 which extends along a fourth side of said bottom, between and generally perpendicular to said border flanges 20 and 20' in said first and second wall structures, and projects vertically above the horizontal plane of said bottom in a corresponding first vertical plane located adjacent said fourth side of said bottom. Preferably, the end portions of said fourth border flange will project upwardly above said bottom to a height which is the same as said border flanges 20 and 20', and the central portion of said fourth border flange 38 will project upwardly to a height which is not more than about one-half the height of said border flanges 20 and 20'. In these preferred embodiments of the invention the upper rail members 14 and 14' in said first and second wall structures are each shorter in length than, and terminate inboard the ends of, the border flanges 20 and 20' therebelow. Preferably, an inclined brace member 40 or 40' extends between each said shortened upper rail member 14 or 14' and said border flanges 20 or 20' located therebelow.

The structure of the stacking feet and the stacking saddles provided on the containers of the invention is not critical. Any suitable structures, e.g., substantially flat surfaces, can be employed for said stacking feet and said stacking saddles. However, the stacking saddles 16 and 16' provided in said first and second wall structures will preferably comprise a horizontal surface formed by providing a recessed socket in the upper end of a said bar member 18 or 18' on the side of said bar member which faces said third wall structure. Similarly, each said stacking foot 12 or 12' which is located at the lower end of one of said inclined bar members in said first and second wall structures will comprise a downwardly extending post and a horizontal surface formed by providing a recess extending across the lower end of a said bar member on the side of said bar member which is adjacent the outer surface of the border flange 20 or 20' to which said bar member is secured, with each said post being adapted to extend into a said socket of a stacking saddle. Preferably, each said stacking ledge 48 located on said third upper rail member 24 will comprise an elevated crown and an associated recess formed on the tops of the bar members in said third wall structure. Preferably, each said stacking lug 34 located on said third lower border flange 22 will comprise a downwardly extending post and a horizontal surface formed by providing a recess extending across the bottom of said lug and will be adapted to coact with said elevated crown and its associated recess of said stacking ledges 48.

In the presently most preferred embodiments of the invention, the containers of the invention will also be provided with means for stacking an upper container within a like oriented lower container of like construction at an elevation intermediate the low level nesting position and the high-stack position. Said intermediate stacking means can preferably comprise a plurality of spaced apart intermediate stacking supports disposed on one of (a) the inner surfaces of said upper rail members 14 and 14', or (b) the outer surfaces of said lower border flanges 20 and 20', at an elevation intermediate the elevations of, and in vertical alignment with, said stacking feet 12 and 12' and said stacking saddles 16 and 16', whereby an upper said container can be vertically stacked within a like oriented lower container of like construction at said intermediate elevation when at least some of the stacking feet of the upper container are in vertical alignment with, and in register with, at least some of said intermediate stacking supports in the corresponding wall structure of said lower container. Preferably, said intermediate stacking supports will ordinarily be disposed on the inner surfaces of said upper rail members 14 and 14'.

When the containers of the invention are provided with a third wall structure as described above, it is preferred that said third wall structure also be provided with intermediate stacking supports for coacting with said stacking lugs 34. Preferably, the inclined bar members in said third wall structure are successively inclined in opposite directions to form alternating truncated V-forms and inverted truncated V-forms. For example, referring to FIGS. 1 and 5, said bar members 32–30 form a truncated V-form, said bar members 30–28 form an inverted truncated V-form, and said bar members 28–26 form a truncated V-form. Preferably, a connecting member(s), such as member 44, is disposed on the inner surface of said third upper rail member 24 between and connects the adjacent upper end portions of those said bar members forming an inverted V-form, e.g., bar members 28 and 30. Preferably, an extension member(s) 46 is disposed on the inner surface of said third upper rail member 24, is connected to, and horizontally extends the upper end portions of those said bar members which do not form an inverted V-form, e.g., bar members 26 and 32. A plurality of spaced apart stacking ledges 48 are formed on the upper edges of said connecting member 44 and said extension members 46, in vertical alignment with said stacking lugs 34 in said corresponding second vertical plane, and at an elevation corresponding to that of said stacking saddles 16 and 16' in said first and second wall structures. A plurality of openings 50, corresponding in number to said stacking lugs 34, are formed in and extend through said third upper rail member 24. When said connecting member(s) 44 and said extension member(s) 46 are provided, said openings 50 also extend therethrough as illustrated. Said openings 50 are disposed in vertical alignment with said stacking lugs 34 in said corresponding second vertical plane. An intermediate stacking ledge 52 extends across the lower portion of each of said openings 50 at an intermediate elevation corresponding to the elevation of said intermediate stacking supports 42 and 42' in said first and second wall structures, whereby when an upper said container is vertically stacked at said intermediate elevation, within a like oriented lower container of like construction, said stacking lugs 34 extend into said openings 50 and are in register with said stacking ledges 52 therein.

Referring now to FIG. 23, in the container there illustrated the upper rail members, e.g., rail member 54', are of substantially the same length as the border flanges, e.g., border flange 56', therebelow. In this embodiment of the invention, the inclined brace members 40 and 40' provided in the container of FIG. 1 are omitted. In all other respects, the container of FIG. 23 can be essentially like the container of FIG. 1.

FIG. 14 illustrates one nesting relationship of containers of the invention, e.g., the container illustrated in FIG. 1. As indicated by FIG. 14, in the nesting operation the upper container is moved diagonally downward into the lower container to place the bar members of the upper container parallel to the bar members in the corresponding wall structures of the lower container, with the stacking feet of the upper container out of register with the stacking saddles of the lower container. It will be evident from this disclosure that this nesting relationship can also be obtained with the container illustrated in FIG. 23. Said nesting relationship can be obtained when the containers of the invention are, or are not, provided with the above described third wall structure. For example, referring to FIG. 5, it is evident that an upper container will fit into a lower container with the bar members in the third wall structure of the upper container paralleling the corresponding bar members in the third wall structure of the lower container. The depth or extent of the nesting of the upper container within the lower container can be varied by varying the height of the upper rail member, and/or the height of the lower border flange when the containers are provided with lower border flanges. It is usually preferred that the lower border flanges of the containers extend vertically above the horizontal plane of the bottom panel to a height sufficient to provide from about one to about three inches clearance between the bottom panels of adjacent nested containers. This clearance is useful for low profiled baked products.

The nesting relationship illustrated in FIG. 14 is referred to as vertical in-line nesting. In such nesting the upper rail members (and the lower border flanges when present) of the upper container are vertically in-line with the corresponding members of the lower container. However, it is also within the scope of the invention to nest the containers of the invention in a vertical off-set nested relationship when the containers are light duty containers and comprise only the above-described first and second wall structures. This nesting relationship is illustrated diagrammatically in FIG. 24. Herein and in the claims, unless otherwise specified, the terms "vertically nest" or "nest vertically" are employed generically and include both said vertical in-line nesting and said vertical off-set nesting.

The stacking of containers of the invention, e.g., the container of FIG. 1, in a high-stack relationship is illustrated in FIGS. 16 and 18. In the high-stack relationship illustrated, the stacking feet 12 and 12' of the upper container are in vertical alignment with and in register with the stacking saddles 16 and 16' of a like oriented lower container of like construction. Thus, in the embodiment illustrated in FIGS. 1, 16, and 18 the downwardly extending posts of the stacking feet 12 and 12' extend into the sockets of stacking saddles 16 and 16', of said first and second wall structures. In the third wall structure provided at the rear of the container, the stacking lugs 34 on third border flange 22 are in vertical alignment with and in register with the stacking ledges 48 located on the inner surface of the third upper rail member 24. Thus, in the embodiment illustrated in FIGS. 1 and 13*a* the downwardly extending posts of stacking lugs 34 extend into the recesses of the stacking ledges 48. The above described interlocking relationship of the stacking feet and stacking saddles in the first and second wall structures, and the interlocking relationship between the stacking lug and stacking ledges in the third wall structure, provide positive interlocks which prevent either transverse or lateral movement of the stacked containers with respect to each other. Said positive interlocking also offsets any tendency for outward spreading of the walls of the lower containers (due to the weight of the upper containers) in a high stack of loaded containers. It will also be noted that in said high-stack relationship illustrated in FIG. 16, the lower edges of the border flanges of the upper container, e.g., flange 20', are below and within the upper edges of the upper rail members of the lower container, e.g., upper rail member 14', thus providing further interlocking of the stacked containers.

It is clear from this disclosure that the above high-stack relationship can be obtained by placing an upper container vertically above a like oriented lower container of like construction, and then lowering said upper container until the stacking feet thereof register with the stacking saddles of the lower container. However, the above described rear blind stacking means and front blind stacking means are useful and advantageous when stacking containers of the invention in said high-stack relationship. As used herein and in the claims, unless otherwise specified, the "front" of the container is considered to be the open end of the container, i.e., the end where lower border flange 38 is located; and the "rear" of the container is the opposite end which is "closed" by the third wall structure comprising lower border flange 22 and upper rail member 24.

Said rear blind stacking means is particularly useful when a plurality of containers are being stacked to a relatively low height, e.g., below about shoulder height of the operator stacking the containers. For example, referring to FIGS. 1, 4, and 5, when it is desired to employ said rear blind stacking means, an upper container is placed above a like oriented lower container of like construction with the rear wall structure of said upper container disposed rearwardly of the rear wall structure of said lower container, and with the lower border flanges 20 and 20' of said upper container resting on upper rail member 24 of said lower container and inside boss members 36 on said upper rail member. Preferably, the front of the lower container will be raised slightly from the horizontal. Then, lowering the front of the upper container to substantially horizontal position, and sliding the container forward, will cause said upper container to automatically drop into the high-stack relationship when the lower border flange 22 thereof has crossed the upper rail member 24 of said lower container. Thus, it is not necessary to meticulously align the stacking feet of the upper container and the stacking saddles of the lower container prior to said automatic dropping into registration thereof.

Said front blind stacking means is particularly useful when a plurality of containers are being stacked to a relatively high height, e.g., above about shoulder height of the operator stacking the containers. For example, referring to FIGS. 1, 4, 16, and 19–22, when it is desired to employ said front blind stacking means, an upper container is lifted above a like oriented lower container of like construction and the forward stacking feet 58 and 58' having the upper inner curved surface are placed over the curved-top posts 60 and 60' on the forward stacking saddles, with said upper container being held at a forwardly inclined angle with respect to said lower container. Then, lowering the rear portion of said upper container onto said lower container will cause the stacking feet and stacking lugs of said upper container to automatically register with the stacking saddles and the stacking ledges of said lower container in said high-stack relationship. Thus, it is not necessary to meticulously align the stacking feet of the upper container with the stacking saddles of the lower container prior to said automatic registration thereof.

The stacking of containers of the invention in an intermediate-stacking relationship is illustrated in FIGS. 13, 15, and 17. In the intermediate-stacking relationship illustrated, the stacking feet 12 and 12' of the upper container are in vertical alignment with and in registration with the intermediate stacking supports 42 and 42', respectively, of a like oriented lower container of like construction. Thus, in the embodiment of the invention illustrated in FIGS. 1, 15, and 17 the downwardly extending posts of stacking feet 12 and 12' extend into the sockets of intermediate stacking supports 42 and 42' in the first and second wall structures. In the third wall structure, the stacking lugs 34 on the third border flange 22 are in vertical alignment with and in registration with the stacking ledges 52 which extend across the bottom of openings 50. Thus, there is obtained in the intermediate-stack position an interlocking between the stacked containers like that obtained in the above described high-stack position.

In the container illustrated in FIGS. 1, 13, 15 and 17, said intermediate-stack position can be obtained by positioning an upper container above a like oriented lower container of like construction, and with the front of the upper container shifted slightly forward of the front of the lower container. The upper container is then lowered diagonally downwardly toward the rear of the lower container to bring the stacking feet and lugs of the upper container into registration with the intermediate stacking supports and ledges of the lower container.

When a said upper container is in the above described high-stack position on a said lower container, the upper container can be moved to either the above described intermediate-stack position or to the above described low nest position by lifting the upper container, then shifting the upper container slightly forward with respect to the lower container, and then lowering the upper container diagonally downward toward the rear of the lower container. The amount of said forward shifting will determine whether the upper container goes into the intermediate-stack position or into the low nest position.

The above described high-stack relationship illustrated in FIG. 16, and the above described intermediate-stack relationship illustrated in FIG. 15, are referred to as vertical in-line stacking. In such stacking the upper rail members, and the lower border flanges when present, of the upper container are vertically in-line with the corresponding members of the lower container. However, it is also within the scope of the invention to high-stack, or intermediate-stack, containers of the invention in a vertical off-set relationship when the containers are light duty containers and comprise only the above described first and second wall structures. This off-set relationship for the high-stack position is illustrated diagrammatically in FIG. 25. Thus, herein and in the claims, unless otherwise specified, the terms "vertically stack" or "stack vertically" are employed generically and include both said vertical in-line stacking and said vertical off-set stacking.

With minor modifications the containers of the invention can be stacked in said vertical off-set stacking position and canted with respect to the horizontal. The containers can be held in said canted position by any suitable support means (not shown) placed under the rear portion of the lower container, e.g., under the right hand end of the lower container in FIG. 25. Such an arrangement is useful for display purposes. The degree of off-set of the upper container will determine the amount of the lower container interior which is exposed for display. To obtan such an arrangement it is preferred that the forward stacking feet 58 (see FIG. 21) on the containers be modified. This modification can comprise removing a part of said forward stacking feet so that they will register in a compatible manner with the stacking saddles 16 and 16'. This modification is illustrated in FIG. 27 (compare with FIG. 21). When the containers to be placed in this canted relationship are provided with third wall structures, a suitably located notch can be provided in the bottom of border flanges 20 and 20' for registration with upper rail members 24 of the third wall, if desired.

The above described structures of the containers of the invention provides a number of advantages in the use of said containers. For example, the essentially vertical walls of the containers wherein the various elements in the wall structures are in adjacent vertical planes have greater vertical strength than the walls in those containers of the prior art which taper or diverge for nesting. This greater strength is obtained even though the wall structure of the containers of the invention comprises spaced apart inclined bar members. Said greater wall strength is valuable when loaded containers are stacked to considerable heights. The above described interlocking relationship of the stacking feet and lugs with the stacking saddles and supports contributes to this increased wall strength. Furthermore, the spaced apart bar members reduce the weight of the container.

The fact that the containers of the invention are three-position containers which can be nested at one height and then stacked at two additional heights, all without rotating an upper container with respect to a lower container, is a definite advantage over those containers of the prior art which must be rotated for stacking or nesting. As mentioned above, this three-position stacking or nesting increases the utility of the containers, making it unnecessary to have different containers for different products.

The walls of the containers are substantially flat. This facilitates mechanical handling as on conveyor belts. The substantially flat outer surface of the upper rail members prevents interlocking of adjacent containers, such as can occur with containers of the prior art which are provided with convolutions, corrugations, etc. in the walls thereof. Said upper rail members also provide convenient handles for the containers without weakening the wall structure of the containers.

The containers of the invention can be fabricated in any suitable manner known to the art. Injection molding, for example, is one presently preferred method for fabricating said containers. Said containers can be fabricated from any suitable material. High density polyethylenes are especially desirable materials from which to fabricate said containers. The high density polyethylenes prepared by the methods disclosed and claimed by J. P. Hogan et al in U.S. Pat. No. 2,825,721, issued Mar. 4, 1958, comprise one group of presently preferred materials. Said containers can also be fabricated from butadienestyrene copolymers, and other plastic materials. If desired, a reinforcing fibrous material, such as asbestos or glass fibers, can be incorporated in the plastic material. While the various plastics are presently preferred for the manufacture of the containers, it is within the scope of the invention to fabricate said containers from other materials, e.g., lightweight metals such as aluminum, reinforced pulp materials, etc.

As an example, one model of a container fabricated in accordance with the invention had an overall length of about 27.75 inches, an overall width of about 22.38 inches, and an overall height of about 6.38 inches. Stacking lugs 34 had a width of about 1 inch. Inclined bar members 18 and 18' had an overall length of about 6.75 inches. Upper rail members 14 and 14' had a height of about 2.1 inches. Lower border flanges 20 and 20' had a height of about 2.25 inches. The upper surface of the T-bars in the gridwork bottom was approximately ¼ inch. The dimensions of the other elements of the container were generally proportional in size.

Herein and in the claims, the word "rectangular" has been employed generically to include four-sided structures which are generally square and four-sided structures wherein one pair of sides is longer than the other pair of sides.

While certain embodiments of the invention have been described for illustrative purposes, the invention is not limited thereto. Various other modifications or embodiments of the invention will be apparent to those skilled in the art in view of this disclosure. Such modifications or embodiments are within the spirit and scope of the disclosure.

We claim:

1. A nesting and stacking container of integrally molded construction comprising:

a generally rectangular horizontal bottom and opposed first and second walls projecting upwardly from said bottom, each said wall comprising:

an upper rail member located above said bottom, spaced vertically therefrom, parallel therewith and located in a vertical plane outside the outer edge of said bottom;

a plurality of bar members connecting said bottom with said upper rail, all said bars being located in a vertical plane inside the vertical plane of said rail member, parallel therewith, and outside the outer edge of said bottom, said bars in said plane being inclined in the same direction at the same angle and spaced one from the other a distance at least equal to the width of said bars;

a stacking foot on the bottom of each bar; and a stacking saddle on the top of each bar, each such stacking saddle being adapted to receive a stacking foot;

the angle of inclination of said bars being such that the stacking foot of one bar is directly in vertical line with the stacking saddle of an adjacent bar inclined toward said one bar;

whereby an upper container will stack vertically on a like oriented lower container with stacking saddles of the lower container receiving stacking feet of the upper container, and will nest with said lower container without relative rotation of said container when said bars of said upper container are positioned between said bars of said lower container, such that at nest position with said lower container, the lower edge of said upper rail member of said upper container is in register with the upper edge of the like upper rail of said lower like container.

2. A container according to claim 1 wherein:

each said wall also includes a plurality of intermediate stacking supports located in the same vertical plane with said bars, said intermediate stacking supports being positioned at an elevation intermediate the elevations of said stacking feet and said stacking saddles, whereby an upper container also can be vertically stacked within a like oriented lower container at said intermediate elevation with intermediate stacking supports of the lower container receiving stacking feet of the upper container.

3. A container according to claim 2 wherein:

a third vertical wall structure extends between said first and second walls at one end of said bottom, and wherein said third wall comprises:

an additional upper rail member located above said bottom, spaced vertically therefrom, parallel therewith, and located in a vertical plane outside the outer edge of said bottom; and a plurality of spaced apart inclined bar members connecting said bottom with said additional upper rail member said inclined bar members being located in a vertical plane inside the vertical plane of said additional upper rail member parallel therewith and outside the outer edge of said bottom, the location, arrangement, and inclination of said inclined bar members being such that said container will nest within a like oriented container of like construction with the said bar members of corresponding third wall structures paralleling each other.

4. A container according to claim 1 wherein:

a lower border flange extends along said side of said bottom in a first vertical plane located adjacent said side;

said stacking feet are disposed on the outer surface of said border flange in a second vertical plane which is located outside and adjacent said first vertical plane;

said upper rail member is disposed in a third vertical plane which is located outside and adjacent said second vertical plane; and said inclined bar members extend between the outer surface of said border flange and the inner surface of said upper rail member and are located in said second vertical plane.

5. A container according to claim 4, also including a third wall substantially the same height as and connecting one end of said first and second walls.

6. A container according to claim 5 wherein:

in each of said first and second wall structures, the upper end of said inclined bar member which is most removed from said third wall structure is curved and comprises one-half of a separable post and socket combination for guiding an upper container in one pre-stacking operation when stacking same on a like oriented lower container of like construction; and in each of said first and second wall structures, the upper inner surface of said stacking foot which is most removed from said third wall structure has a curvature corresponding to said curved upper end of said inclined bar member and comprises the other one-half of said post and socket combination.

7. A container according to claim 6 wherein:

said border flange in each of said first and second wall structures projects vertically above and below the horizontal plane of said bottom; and a pair of boss members project upwardly from said third upper rail member at individual spaced apart positions located in said second vertical plane and are adapted to coact with and guide the downwardly extending portions of said border flanges in another pre-stacking operation.

8. A container according to claim 5 wherein:

a fourth lower border flange extends along a fourth side of said bottom, between and generally perpendicular to said border flanges in said first and second wall structures, and projects vertically above the horizontal plane of said bottom in a corresponding first vertical plane located adjacent said fourth side of said bottom, with the central portion thereof projecting upwardly to height which is not more than about one-half the height of said border flanges in said first and second wall structures;

said upper rail members in said first and second wall structures are each shorter in length than, and terminate inboard the ends of, the border flanges therebelow; and an inclined brace member extends between each said shortened upper rail member and the outer surface of the said border flange located therebelow.

9. A container according to claim 2 wherein there is also provided a third wall structure positioned between and generally perpendicular to said first and second wall structures, and wherein said third wall structure comprises:

a third lower border flange extending along a third side of said bottom in a corresponding first vertical plane located adjacent said third side of said bottom, with the ends of said third border flange connected to adjacent ends of the border flanges in said first and second wall structures;

a third upper rail member disposed generally vertically above said third border flange in a corresponding third vertical plane which is located outside and adjacent a corresponding second vertical plane described hereinafter; and a plurality of spaced apart inclined bar members extending upwardly between the outer surface of said third border flange and the inner surface of said third upper rail member, and disposed in said corresponding second vertical plane which is located outside and adjacent said corresponding first vertical plane, with the location, arrangement, and inclination of said bar members being such that said container will nest within a like oriented container of like construction with the said bar members of corresponding third wall structures paralleling each other.

10. A container according to claim 9 wherein:

a plurality of spaced apart outwardly extending stacking lugs are disposed on the outer surface of said third border flange, in said corresponding second vertical plane, and at an elevation corresponding to that of said stacking feet in said first and second wall structures;

said bar members are successively inclined in opposite directions to form alternating truncated V-forms and inverted truncated V-forms; and a plurality of spaced apart stacking ledges are associated with the upper ends of said bar members on the inner surface of said third upper rail member, in said corresponding second vertical plane, in vertical alignment with said stacking lugs, and at an elevation corresponding to that of said stacking saddles in said first and second wall structures.

11. A container according to claim 9 wherein:

each said stacking saddle located at the upper ends of said bar members in said first and second wall structures comprises a horizontal surface formed by providing a recessed socket in the upper end of a said bar member on the side thereof which faces said third wall structure;

each said stacking foot located at the lower ends of said bar members in said first and second wall structures comprises a downwardly extending post and a horizontal surface formed by providing a recess extending across the lower end of a said bar member on the side thereof adjacent the outer surface of the border flange to which said bar member is secured, with said post being adapted to extend into said socket of said stacking saddle;

each said stacking ledge located on said third upper rail member comprises an elevated crown and an associated recess formed on the tops of said bar members in said third wall structure; and each said stacking lug located on said third lower border flange comprises a downwardly extending post and a horizontal surface formed by providing a recess extending across the bottom of said lug and is adapted to coact with said elevated crown and its associated recess of said stacking ledge.

12. A container according to claim 4 wherein:

a plurality of spaced apart intermediate stacking supports are disposed on one of (a) the inner surfaces of said upper rail member or (b) the outer surface of said lower border flange at an elevation intermediate the elevations of, and in vertical alignment with, said stacking feet and said stacking saddles, whereby an upper said container can be vertically stacked within a like oriented lower container of like construction at said intermediate elevation when at least some of the stacking feet of said upper container are in vertical alignment with and in register with at least some of said intermediate stacking supports in the corresponding wall structure of said lower container.

13. A container according to claim 12 wherein said intermediate stacking supports are disposed on the inner surface of said upper rail member.

14. A container according to claim 13 wherein there is also provided a third wall structure positioned between and generally perpendicular to said first and second wall structures, and wherein said third wall structure comprises:

a third lower border flange extending along a third side of said bottom in a corresponding first vertical plane located adjacent said third side of said bottom, with the ends of said third border flange connected to adjacent ends of the border flanges in said first and second wall structures;

a third upper rail member disposed generally vertically above said third border flange in a corresponding third vertical plane which is located outside and adjacent a corresponding second vertical plane described hereinafter; and a plurality of spaced apart inclined bar members extending upwardly between the outer surface of said third border flange and the inner surface of said third upper rail member, and disposed in said corresponding second vertical plane which is located outside and adjacent said corresponding first vertical plane, with the location, arrangement, and inclination of said bar members being such that said container will nest within a like oriented container of like construction with the said bar members of corresponding third wall structures paralleling each other.

15. A container according to claim 14 wherein:

in each of said first and second wall structures, the upper end of said inclined bar member which is most removed from said third wall structure is curved and comprises one-half of a separable post and socket combination for guiding an upper container in one pre-stacking operation when stacking same on a like oriented lower container of like construction; and in each of said first and second wall structures, the upper inner surface of said stacking foot which is most removed from said third wall structure has a curvature corresponding to said curved upper end of said inclined bar member and comprises the other one-half of said post and socket combination.

16. A container according to claim 15 wherein:

said border flange in each of said first and second wall structures projects vertically above and below the horizontal plane of said bottom; and a pair of boss members project upwardly from said third upper rail member at individual spaced apart positions located in said second vertical plane and are adapted to coact with and guide the downwardly extending portions of said border flanges in another said pre-stacking operation.

17. A container according to claim 16 wherein:

a fourth lower border flange extends along a fourth side of said bottom, between and generally perpendicular to said border flanges in said first and second wall structures, and projects vertically above the horizontal plane of said bottom in a corresponding first vertical plane located adjacent said fourth side of said bottom, with the central portion thereof projecting upwardly to height which is not more than about one-half the height of said border flanges in said first and second wall structures;

said upper rail members in said first and second wall structures are each shorter in length than, and terminate inboard the ends of, the border flanges therebelow; and an inclined brace member extends between each said shortened upper rail member and the outer surface of the said border flange located therebelow.

* * * * *

UNITED STATES PATENT OFFICE

CERTIFICATE OF CORRECTION

PATENT NO. : 4,102,453

DATED : July 25, 1978

INVENTOR(S) : James C. Carroll; Lewis T. Johnson

It is certified that error appears in the above-identified patent and that said Letters Patent are hereby corrected as shown below:

Column 14, line 51, delete "2" and insert --- 4 ---.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*